US006928915B2

(12) United States Patent
Jensen et al.

(10) Patent No.: US 6,928,915 B2
(45) Date of Patent: Aug. 16, 2005

(54) SLICING MACHINE WITH PLUG PREVENTION DEVICE

(75) Inventors: Richard B. Jensen, Caldwell, ID (US); David B. Walker, Meridian, ID (US); Allen J. Neel, Nampa, ID (US); Heriberto Banda, Heyburn, ID (US)

(73) Assignee: J. R. Simplot Company, Boise, ID (US)

( * ) Notice: Subject to any disclaimer, the term of this patent is extended or adjusted under 35 U.S.C. 154(b) by 0 days.

(21) Appl. No.: 10/690,799

(22) Filed: Oct. 21, 2003

(65) Prior Publication Data

US 2004/0079213 A1 Apr. 29, 2004

Related U.S. Application Data

(60) Provisional application No. 60/422,271, filed on Oct. 29, 2002.

(51) Int. Cl.[7] ..... B26D 1/12; B26D 7/06

(52) U.S. Cl. ..... 83/418; 83/663; 83/932; 241/84; 99/538

(58) Field of Search ..... 83/418, 663, 932, 83/403, 411 R, 419, 733, 420, 421, 409, 698.41, 699.51; 99/538, 537; 30/280; 241/84, 85, 242, 285.1, 285.2

(56) References Cited

U.S. PATENT DOCUMENTS 2,631,785 A * 3/1953 Bogie ..... 241/78
2,835,297 A * 5/1958 Kochalski ..... 241/222
2,859,784 A * 11/1958 Woodward et al. ..... 83/403
2,923,337 A * 2/1960 Jouin ..... 83/403
3,139,130 A 6/1964 Urschel et al.
3,675,696 A * 7/1972 Weichel ..... 241/28
3,857,310 A * 12/1974 Tiby ..... 83/26
4,063,633 A * 12/1977 Hall ..... 198/455
4,206,671 A * 6/1980 Hoehn ..... 83/408
4,391,172 A * 7/1983 Galland et al. ..... 83/403
4,625,606 A 12/1986 Pinegar et al.
4,945,794 A * 8/1990 Quo et al. ..... 83/13
4,971,259 A * 11/1990 Nidiffer ..... 241/34
5,010,796 A * 4/1991 Mendenhall ..... 83/865
5,385,074 A * 1/1995 Burch, Jr. ..... 83/865
6,550,702 B2 * 4/2003 Champlin ..... 241/55
2002/0144584 A1 * 10/2002 Arrasmith et al. ..... 83/663
2003/0145698 A1 * 8/2003 Bucks ..... 83/13

* cited by examiner

*Primary Examiner*—Allan N. Shoap
*Assistant Examiner*—Ghassem Alie
(74) *Attorney, Agent, or Firm*—Kelly Lowry & Kelley, LLP

(57) ABSTRACT

A plug prevention device is provided in a slicing machine having a rotary impeller for carrying products such as potatoes or the like into engagement with cutting knives to form lattice cut slices, wherein the plug prevention device prevents the products from lodging within an upwardly open inlet throat of the impeller. The plug prevention device comprises an elongated stationary rod having one end projecting into the impeller throat at a position substantially off-axis relative to an axis of impeller rotation. Products entering the impeller and tending to lodge by centrifugal action against an internal wall of the impeller throat will strike the rod, causing such products to separate from wall of the impeller throat and fall further into the impeller for slice processing.

20 Claims, 4 Drawing Sheets

SLICING MACHINE WITH PLUG PREVENTION DEVICE

This application claims the benefit of U.S. Provisional Application No. 60/422,271, filed Oct. 29, 2002.

BACKGROUND OF THE INVENTION

This invention relates generally to improvements in devices and methods for cutting food products such as vegetable products, and particularly such as potatoes, into lattice cut slices. More particularly, this invention relates to a relatively simple yet highly effective modification of a slicing machine of a type having a rotary impeller for carrying the food products into cutting engagement with lattice cut slicing knives, wherein the improvement comprises a plug prevention device for preventing the food products from lodging within and plugging an inlet throat of the rotary impeller.

Potato slices having a lattice or waffle cut geometry represent a popular food product. Such potato slices are characterized by corrugated cut patterns on opposite sides of each slice, wherein the opposing cut patterns are angularly oriented relative to each other such as at approximate right angles. The troughs or valleys of the opposing corrugated cut patterns are desirably sufficiently deep to partially intersect one another, resulting in a potato slice having a generally rectangular grid configuration with a repeating pattern of small openings formed therethrough. Relatively thin lattice cut slices of this type are commonly processed to form lattice cut potato chips. Thicker lattice cut slices are typically processed by parfrying and/or finish frying to form lattice or waffle cut French fry slices.

Slicing machines have been developed for production cutting of potatoes and other food products into lattice cut slices of the type described above. One such lattice cut slicing machine is shown and described in U.S. Pat. No. 3,139,130, which is incorporated by reference herein. This lattice cut slicing machine comprises an upwardly open housing having a rotary impeller mounted therein for receiving and guiding products such as potatoes into cutting engagement with a plurality of lattice cut slicing knives mounted on a peripheral knife frame. More particularly, the products are fed by suitable conveyor or supply means to fall downwardly into an upwardly open inlet throat of the rotary impeller, which in turn throws the products radially outwardly by centrifugal force into a plurality of radially open guide tubes. These guide tubes support the products as the impeller rotates to carry the products into cutting engagement with the lattice cut slicing knives. In addition, these guide tubes rotate the products through approximately 90°, relative to a radial guide tube axis, between engagement with successive slicing knives, so that the cut patterns formed on opposite sides of each slice are oriented at about right angles to each other. In a production environment, such slicing machine is capable of handling a relatively large mass through-put of products, and typically operates with an impeller speed on the order of about 400 rpm.

One problem encountered with lattice cut slicing machines of this type is that the products fed into the rotary impeller can lodge or hang up within the impeller throat, to plug the machine and prevent product flow-through for lattice cut slicing. This problem occurs most commonly when one or more of the incoming products such as potatoes engages and lodges by centrifugal action against an interior wall surface of the spinning impeller throat. When this occurs, product through-put for cutting is interrupted, and subsequent incoming products will collect and jam at an upstream side of the impeller throat. To resolve this problem, it has been necessary to shut down the slicing machine while the products lodged at and upstream from the impeller throat are manually removed.

There exists, therefore, a need for an improved lattice cut slicing machine, particularly with respect to preventing incoming products such as potatoes from lodging within and plugging the open throat of the rotary impeller. The present invention fulfills this need and provides further related advantages.

SUMMARY OF THE INVENTION

In accordance with the invention, an improved slicing machine is provided for cutting products such as food products, and particularly such as potatoes, into lattice cut slices, wherein the slicing machine includes relatively simple yet effective plug prevention member or means for preventing the products from lodging within and obstructing an open throat of a rotary impeller.

The slicing machine includes an upwardly open housing having a rotary impeller mounted therein and defining an upwardly open throat for receiving products such as potatoes supplied via a suitable conveyor means or the like. The rotary impeller redirects each product by centrifugal force into and through one of a plurality of radially open guide tubes which support the products as they are rotated by the impeller into cutting engagement within a plurality of lattice cut knives mounted on a peripheral knife frame. These guide tubes rotatably turn the products through an angle of about 90° between successive cuts, so that corrugated cut patterns formed on opposite sides of each slice are oriented at approximate right angles to each other. Such slicing machine is shown and described in U.S. Pat. No. 3,139,130, which is incorporated by reference herein.

The plug prevention member or means comprises, in the preferred form, an elongated rod mounted in a stationary position relative to the rotary impeller, with one end of said rod projecting at least partially into the upwardly open impeller throat. The plug prevention rod extends generally in parallel with a vertical axis of impeller rotation, and at a substantial off-axis location to position said one end of the rod near an inner wall surface of the impeller throat. This plug prevention rod is removably supported as by threaded mounting onto a stationary frame member to permit quick and easy disassembly.

In operation, in the event that a product such as a potato becomes lodged by centrifugal action against an inner wall surface of the throat of the rotary impeller, such lodged potato promptly strikes the stationary plug prevention rod to dislodge such potato from the throat wall and thereby enable that potato to fall downwardly through the impeller throat for centrifugal movement into and through one of the radial guide tubes into cutting engagement with the lattice cut knives.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

Figure 1:
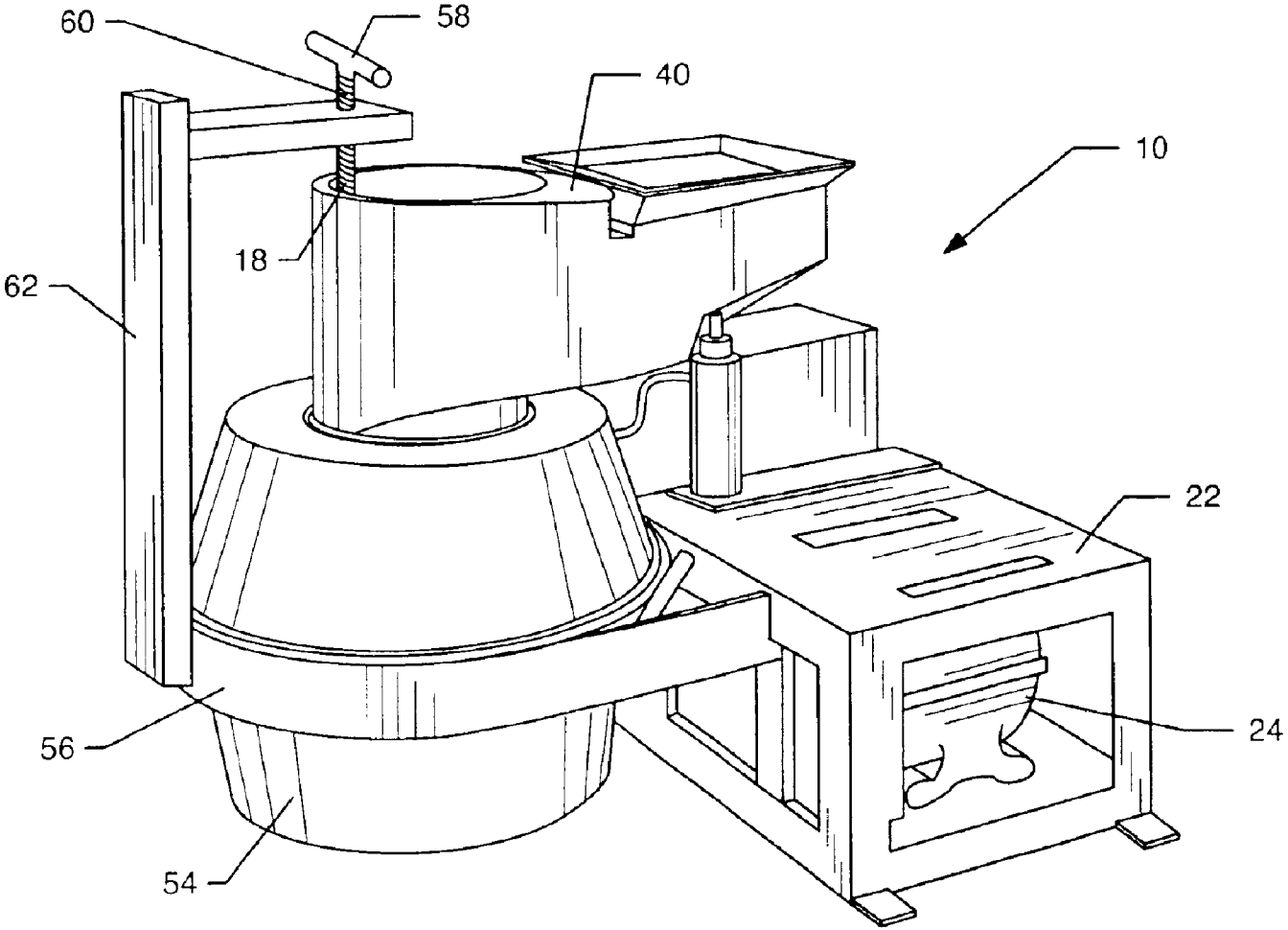
FIG. 1 is a fragmented perspective view illustrating a slicing machine of the general type shown in U.S. Pat. No.
Figure 2:
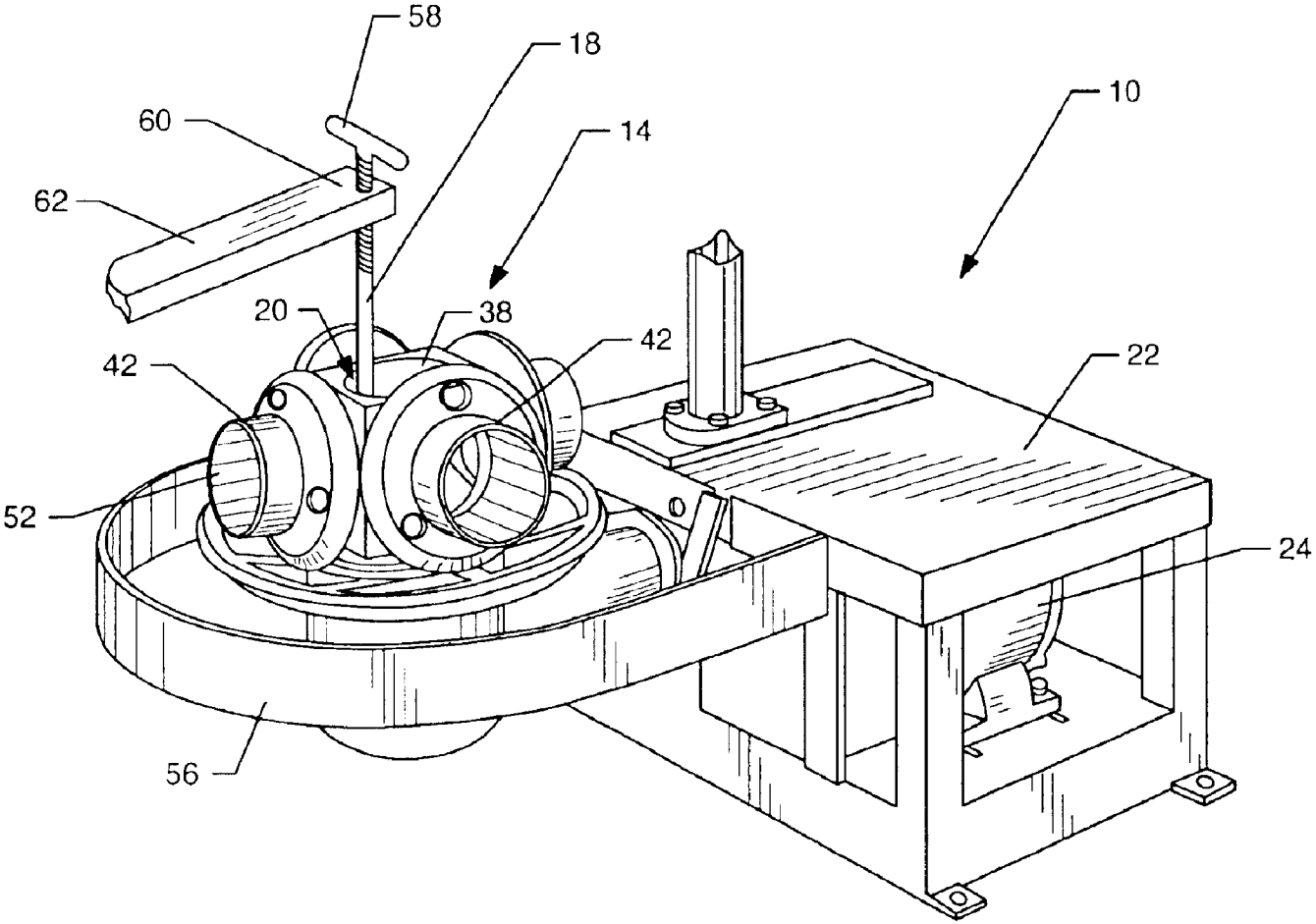
Figure 3:
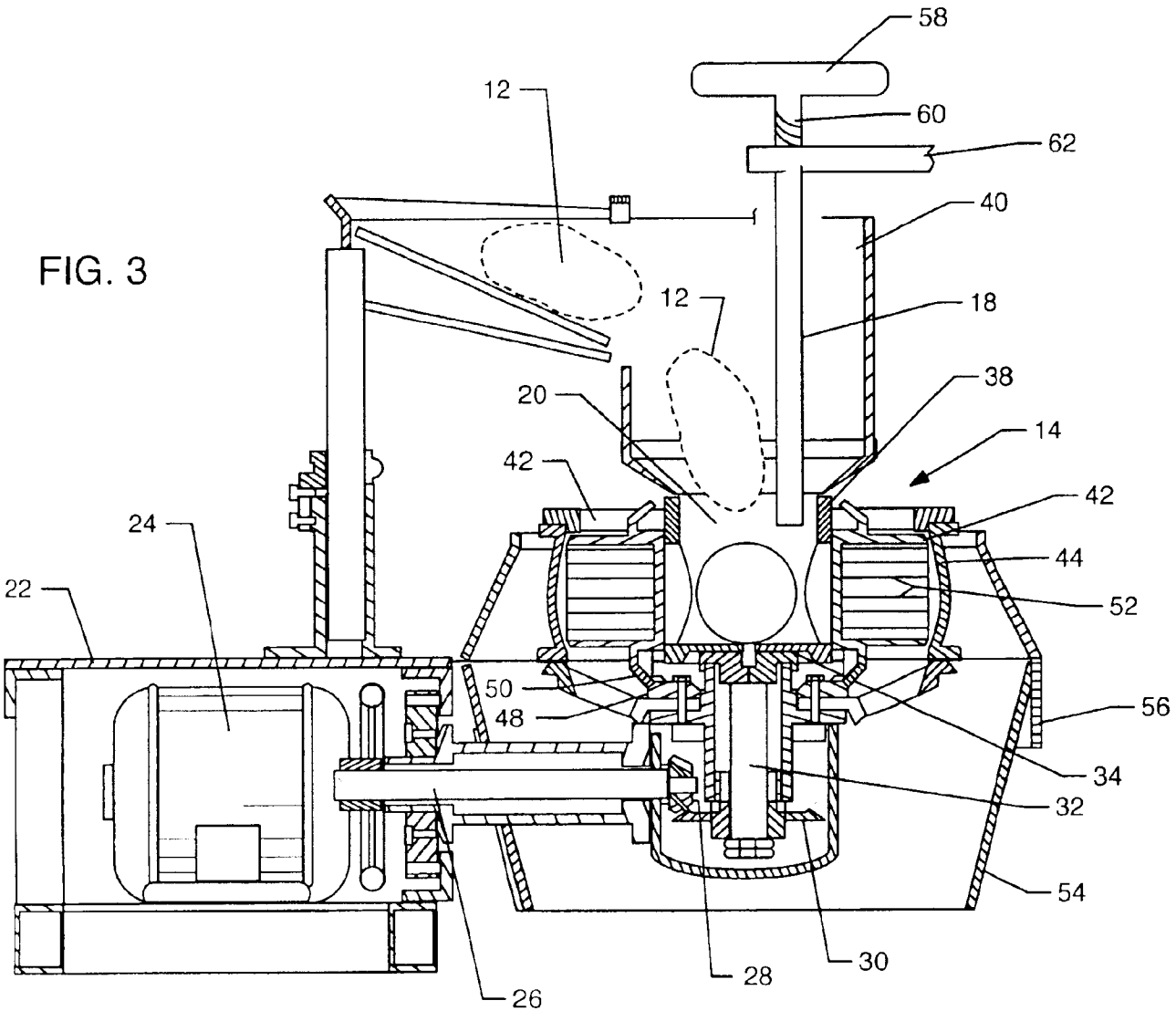
Figure 4:
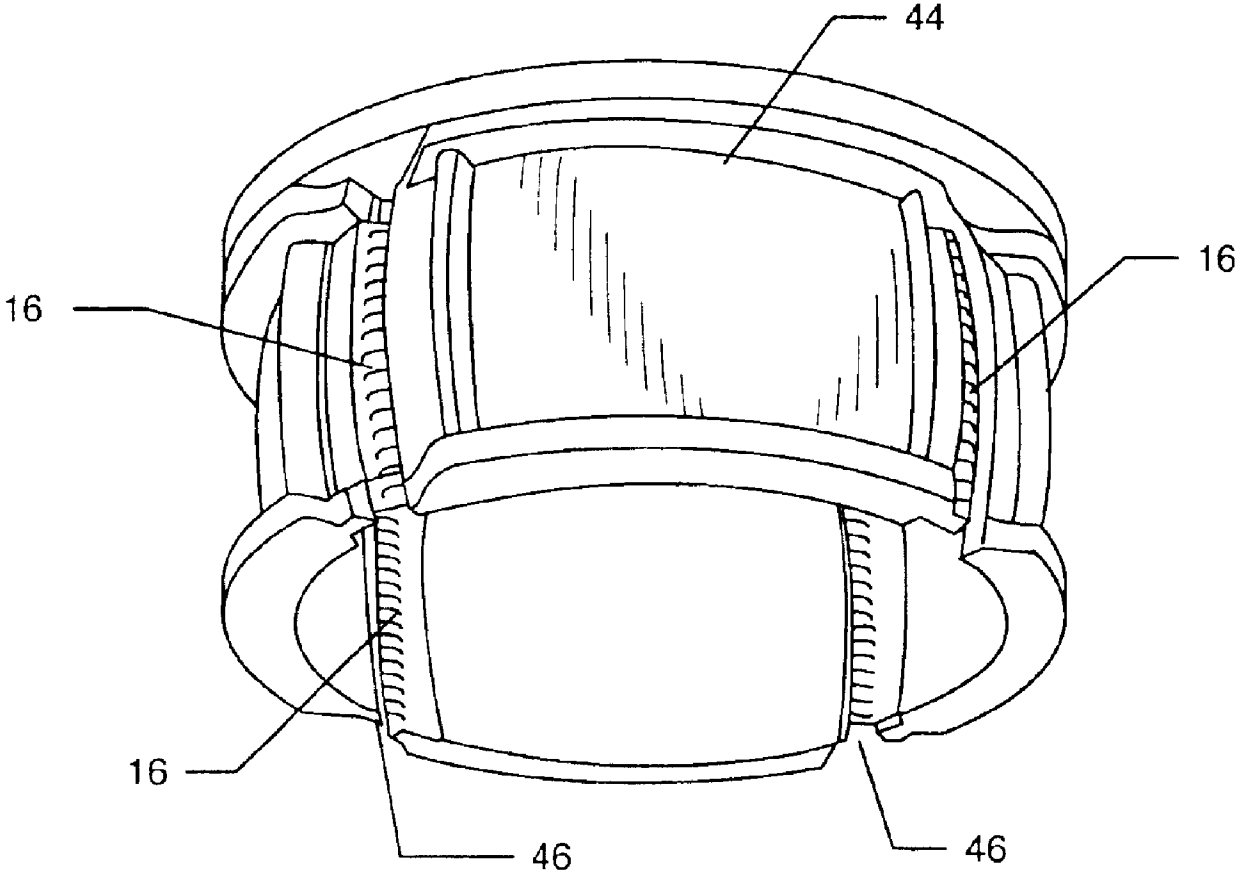

3,139,130, and further including a plug prevention device in accordance with the present invention;

FIG. 2 is a fragmented perspective view of the slicing machine of FIG. 1, with portions thereof removed to illustrate internal components;

FIG. 3 is an enlarged vertical sectional view of the slicing machine of FIG. 1; and FIG. 4 is a perspective view of a portion of the slicing machine, depicting a plurality of lattice cut slicing knives mounted thereon.

DETAILED DESCRIPTION OF THE PREFERRED EMBODIMENT

As shown in the exemplary drawings, a lattice cut slicing machine referred to generally in FIGS. 1–3 by the reference numeral 10 is provided for cutting products such as vegetable products, and particularly such as potatoes 12 (FIG. 3) into a plurality of lattice cut or waffle cut slices of selected thickness. The slicing machine 10 includes a rotary impeller 14 for receiving and carrying the products 12 into cutting engagement with a plurality of lattice cut slicing knives 16 (FIG. 4). The invention resides in the addition of plug prevention means shown in the form of a stationary rod 18 extending at least partially into an upwardly open throat 20 of the rotary impeller 14 for preventing the products from lodging within and plugging the impeller throat.

The illustrated lattice cut slicing machine 10 may be constructed generally in accordance with the slicing machine shown and described in U.S. Pat. No. 3,139,130, which is incorporated by reference herein. As shown, this slicing machine 10 comprises a machine frame or base 22 supporting a drive motor 24 for rotatably driving an output shaft 26 (FIG. 3) which is suitably connected by gear elements 28 and 30 for rotatably driving a vertically oriented impeller shaft 32. This impeller shaft 32 is coupled to the underside of an impeller base plate 34 for rotatably driving the impeller 14 at a selected rotational speed, typically on the order of about 400 rpm, about the vertical axis of the impeller shaft 32.

The base plate 34 of the rotary impeller 14 defines the lower end of a central impeller cavity for receiving products such as the potatoes 12 to be cut. This central cavity is upwardly open, with an upper wall 38 defining the upwardly open throat 20. The potatoes 12 are supplied from a suitable conveyor means (not shown) to an overlying supply chute 40 which may be mounted on the machine frame or base 22, so that the potatoes fall by gravity in relatively rapid succession through the upwardly open impeller throat 20 and further downwardly into the impeller 14 to strike the base plate 34 thereof. The rotational movement of the impeller base plate 34 causes the potatoes falling thereon to be thrown radially outwardly by centrifugal action for passage into one of a plurality of radially open guide tubes 42 (four of which are shown in the illustrative drawings) mounted on the impeller 14 for rotation therewith.

The guide tubes 42 support and carry the potatoes 12 into cutting engagement with the plurality of lattice cut slicing knives 16. These slicing knives 16 are mounted on a stationary or nonrotating and generally cylindrical knife frame 44 which supports the knives 16 at the impeller periphery, and adjacent to a slot 46 formed in the knife frame 44. In addition, each slicing knife 16 has a corrugated geometry consisting of a sequence of alternating peaks and valleys. As each potato 12 is centrifugally thrown by the impeller 14 in a radially outward direction through the associated guide tube 42, the radially outer end of the potato is rotationally carried into cutting engagement in sequence with the slicing knives 16, each of which separates a slice of predetermined thickness from the end of the potato wherein this slice has a corrugated cut pattern. As is known in the art, the cut slices pass through the knife slots 46 and fall by gravity into an underlying collection vessel or conveyor means (not shown).

Importantly, to form the desired lattice cut products having corrugated cut patterns on opposite sides of each cut slice, and preferably wherein the valleys or troughs of the cut patterns partially intersect to form small openings in the cut product, the potatoes 12 are rotated within the guide tubes 42 through an angle of about 90° between engagement with successive slicing knives 16. In this regard, the rotary impeller 14 and the guide tubes 42 mounted thereof additionally include gear elements 48 and 50 for rotating the guide tubes 42 about their respective central axes which extend radially relative to the impeller 14. Internal ribs 52 may be provided in the interior surface of each guide tube 42 for improved gripping engagement with each potato 12 for rotation therein.

The above described lattice cut slicing machine 10 normally includes a contoured outer shroud 54 (FIGS. 1 and 3) for encasing the moving machine components, wherein this shroud is shown suspended on a frame ring 56 attached to the machine base 22.

In accordance with the present invention, the plug prevention means is provided to prevent the products such as the potatoes 12 from lodging within the upwardly open throat 20 of the impeller 14, without falling further into the impeller interior and onto the impeller base plate 34. That is, particularly as a result of the relatively high speed rotation of the impeller 14 during normal production operation, a potato 12 can contact and become trapped by centrifugal force against an inner surface of the throat wall 38, whereupon such potato is rotationally carried on the throat wall 38 without falling further into the impeller interior. When this occurs, subsequent product inflow to the machine 10 can be obstructed by the throat-trapped potato, resulting in jamming and plugging of the inlet throat 20 and corresponding interruption in product flow through the slicing machine 10. The plug prevention rod 18 is mounted to extend at least partially into the impeller throat 20 to prevent entrapment of potatoes therein.

More particularly, the plug prevention rod 18 comprises a rigid and sturdy component formed from stainless steel or the like, having a generally T-shaped upper handle 58 for convenient manipulation and mounting of a threaded upper segment 60 through a threaded bore formed in a frame member 62. This frame member 62 may be securely anchored as by welding or clamping onto the frame ring 56, or to any other secure and fixed position mounting site. Importantly, the frame member 62 supports the rod 18 in a position with a lower end thereof extending or projecting downwardly and at least partially into the impeller throat 20. FIG. 3 shows the plug prevention rod 18 oriented generally in parallel with the vertical rotational axis of the impeller 14, and at a substantial off-axis location to position said rod 18 near an inner surface of the impeller throat wall 38. The distance between the rod 18 and the throat wall 38 is substantially less than the narrow dimension of a potato 12 supplied to the machine 10 for slicing. With this construction, the plug prevention rod 18 can be installed or removed quickly and easily.

In operation, if and when a potato 12 tends to lodge by centrifugal action against the throat wall 38, without falling further and substantially immediately onto impeller base plate 34, such potato 12 is rotationally carried into impact engagement with the plug prevention rod 18 which separates the potato from the throat wall 38. As a result, the otherwise trapped potato is forcibly dislodged from the throat wall 38 and will fall promptly through the inlet throat 20 on into the impeller 14 for slicing. The plug prevention rod 18 thus prevents the products from lodging within and plugging the impeller throat 20, and thereby promotes uninterrupted production operation of the slicing machine 10.

In accordance with a further benefit provided by the invention, it has been found that use of the plug prevention rod 18 permits use of the slicing machine 10 with somewhat larger-sized products such as potatoes. That is, larger potatoes that would otherwise result in increased incidents of plugging within the inlet throat 20 due to potato length or diameter can be used, with the rod 18 promptly dislodging any potato that tends to become trapped within the impeller throat. The rod 18 dislodges such potato and sufficiently shifts the orientation thereof so that the potato will fall further into the impeller for slice processing.

A variety of modifications and improvements in and to the lattice cut slicing machine 10 of the present invention will be apparent to those persons skilled in the art. Accordingly, no limitation on the invention is intended by way of the foregoing description and accompanying drawings, except as set forth in the appended claims.

What is claimed is:

1. In a rotary slicing machine having a rotary impeller for carrying food products into cutting engagement with at least one slicing knife, said rotary impeller having a rotating throat wall defining an upwardly open inlet throat for inflow passage of a succession of food products to be cut, and an overlying supply chute through which food products are supplied to fall by gravity downwardly through said rotating inlet throat and into said impeller, the improvement comprising:

a plug prevention member extending at least partially into said rotating inlet throat at a location disposed substantially off-axis relative to an axis of rotation of said impeller, said rotary impeller being movable relative to said plug prevention member, and said plug prevention member being positioned for impact engagement by food products lodged by centrifugal action against said rotating throat to dislodge such food products from said throat wall and thereby permit such food products to fall downwardly into said impeller for cutting;

said plug prevention member being provided as a component separate from and in addition to the overlying supply chute.

2. The improvement of claim 1 wherein said plug prevention member comprises an elongated rod.

3. The improvement of claim 2 wherein said rod extends generally parallel to a rotational axis of said rotary impeller.

4. The improvement of claim 2 including means for supporting said rod generally above said rotary impeller with a lower end of said rod extending downwardly into said inlet throat.

5. The improvement of claim 4 wherein said rod supporting means is adjustable.

6. The improvement of claim 4 wherein said rod is removably supported by said rod supporting means.

7. The improvement of claim 1 wherein said plug prevention member is stationary.

8. The improvement of claim 1 wherein said plug prevention member extends at least partially into said inlet throat at a location spaced from said throat wall by a distance substantially less than a narrow dimension of said food product.

9. The improvement of claim 1 wherein the food products comprise potatoes.

10. In a rotary slicing machine having a rotary impeller for carrying food products into cutting engagement with at least one slicing knife, said rotary impeller having a rotating throat wall defining an upwardly open inlet throat for inflow passage of a succession of food products to be cut, and an overlying supply chute through which food products are supplied to fall by gravity downwardly through said rotating inlet throat and into said impeller, the improvement comprising:

a stationary plug prevention rod having a lower end extending downwardly at least partially into said rotating inlet throat, said rod being disposed substantially in parallel with and substantially off-axis relative to an axis of rotation of said impeller, and said plug prevention member being positioned for impact engagement by food products lodged by centrifugal action against said rotating throat wall to dislodge such food products from said throat wall and thereby permit such food products to fall downwardly into said impeller for cutting;

said plug prevention member being provided as a component separate from and in addition to the overlying supply chute.

11. The improvement of claim 10 wherein said plug prevention member extends at least partially into said inlet throat at a location spaced from said throat wall by a distance substantially less than a narrow dimension of said food product.

12. A rotary slicing machine, comprising:

a machine frame;

a rotary impeller carried on said frame for rotatable movement on a generally vertically oriented axis of rotation;

drive means for rotatably driving said rotary impeller;

knife means mounted generally at a periphery of said rotary impeller;

said rotary impeller including a central cavity and a throat wall defining an upwardly open rotating inlet throat for inflow passage of a succession of food products, whereby food products within said central cavity are carried radially outwardly by centrifugal force into slicing engagement with said knife means;

an overlying supply chute through which food products are supplied to fall by gravity downwardly through said rotating inlet throat and into said impeller; and plug prevention means disposed generally within said rotating inlet throat at a location relatively near to said throat wall and substantially off-axis relative to the axis of impeller rotation, said impeller being movable relative to said plug prevention means, said plug prevention member being positioned for impact engagement by food products lodged by centrifugal action against said rotating throat wall to dislodge such food products from said throat wall and thereby permit such food products to fall downwardly into said impeller for cutting;

said plug prevention member being provided as a component separate from and in addition to the overlying supply chute.

13. The rotary slicing machine of claim 12 wherein said plug prevention means comprises an elongated rod.

14. The rotary slicing machine of claim 13 wherein said rod extends generally parallel to the rotational axis of said rotary impeller.

15. The rotary slicing machine of claim 13 including means for supporting said rod generally above said rotary impeller with a lower end of said rod extending downwardly into said inlet throat.

16. The rotary slicing machine of claim 14 wherein said rod supporting means is adjustable.

17. The rotary slicing machine of claim 14 wherein said rod is removably supported by said rod supporting means.

18. The rotary slicing machine of claim 12 wherein said plug prevention means is stationary.

19. The rotary slicing machine of claim 12 wherein said plug prevention means extends at least partially into said inlet throat at a location spaced from said throat wall by a distance substantially less than a narrow dimension of said food product.

20. The rotary slicing machine of claim 12 wherein the food products comprise potatoes.

* * * * *